US005222927A

United States Patent [19]

Chang

[11] Patent Number: 5,222,927

[45] Date of Patent: Jun. 29, 1993

[54] COLLAPSIBLE STEPPER CLIMBER EXERCISER

[76] Inventor: Lee C. Chang, 6F-3 No. 15, 63 Lane, Chien Chin Street, Taichung, Taiwan

[21] Appl. No.: 878,849

[22] Filed: May 5, 1992

[30] Foreign Application Priority Data

Jan. 31, 1992 [TW] Taiwan ..... 81300824

[51] Int. Cl.[5] ..... A63B 22/04; A63B 21/02

[52] U.S. Cl. ..... 482/53; 482/126

[58] Field of Search ..... 482/51, 52, 53, 37, 482/126, 133, 121, 122, 123, 129, 130, 908

[56] References Cited

U.S. PATENT DOCUMENTS

| | | | |
|---|---|---|---|
| 4,958,830 | 9/1990 | Huggins et al. | 482/52 |
| 5,000,441 | 3/1991 | Wang | 482/51 |
| 5,029,850 | 7/1991 | van Straaten | 482/126 |
| 5,090,690 | 2/1992 | Huang | 482/52 |

*Primary Examiner*—Stephen R. Crow
*Attorney, Agent, or Firm*—Natan Epstein

[57] ABSTRACT

A physical exercise machine is provided having a stepper exercise assembly and a climber exercise assembly which includes a pair of handles individually slidable on parallel tubular rails against the tension of spring elements contained within the rails. The rails are retractable into a tubular support member for collapsing the machine from an extended to a compact configuration.

11 Claims, 3 Drawing Sheets

COLLAPSIBLE STEPPER CLIMBER EXERCISER

BACKGROUND OF THE INVENTION

1. Field of the Invention:

This invention pertains to the field of physical exercise equipment and in particular relates to a combination stepper/climber exercise machine characterized in that the climber portion of the machine is retractable into a supporting element of the stepper portion of the machine, so that the machine can be collapsed to a compact configuration.

2. State of the Prior Art

Stepper exercise machines provide a simulated stair climbing exercise, and such machines are in popular use. Generally, the stepper machine has two foot operated levers or pedals pivoted to a free-standing supporting frame and synchronized by an appropriate mechanism, such as an interconnecting pulley arrangement, so that one lever rises as the other is depressed. The movement of the foot levers is damped by a resistance element, such as a hydraulic cylinder, to oppose the weight of the user bearing down on the foot levers. The result is an alternating up and down motion of the foot levers as the user's weight is shifted from one lever to the other, simulating the effort required in climbing a staircase.

A climber exercise machine, on the other hand, typically has left and right handles at an overhead level, requiring the user to reach up to grasp the handles, which are alternately pulled down to a chest level against a yielding resistance, the handles returning to their elevated position when pulling force climbing a cliff for example where the arms are called onto to pull-up the weight of the climber along the cliff face.

Combination stepper/climber exercise machines are also known, as exemplified by Wang U.S. Pat. Nos. 5,000,441 and 4,982,952. Both these patented devices have an elongated support member which rises to the full height necessary to support the handles of the climber portion of the exerciser at or above eye level of a user standing on the stepper portion of the device. The overall height of the device can be reduced for shipment or storage only by disassembling the machine. Other known combinations stepper/climber exercise machine suffer from the same shortcoming, in that they can not be readily and conveniently downsized for transport or storage.

What is needed is a combination stepper/climber which can be easily collapsed to a compact configuration when not in use, without need of tooling by the average, mechanically unskilled user.

SUMMARY OF THE INVENTION

The invention disclosed herein addresses the aforementioned need by providing a physical exercise machine of the combined stepper/climber type which is collapsible from an operative extended configuration to a compact configuration.

The machine has a stepper portion which includes a supporting A-frame including two elongated support members pivotably joined at their upper ends and movable apart at their lower ends, and a cross-member connecting the two support members. Two elongated foot operated levers are pivoted to the frame for up-and-down pedaling movement, which is resisted by a damping cylinder connected to each foot lever. A pulley arrangement synchronizes and interconnects the two foot levers such that one lever rises when the other is depressed and vice-versa.

The improved machine also has a climber portion which includes a pair of handles individually slidable on parallel tubular rails against the tension of spring elements contained in the rails. The improved machine is characterized in that the two rails are retractable into one of the tubular support members of the frame for collapsing the machine from the extended to the compact configuration. In a preferred form of the invention, the spring elements are elastic cords which have an inner end anchored within a corresponding rail, and an opposite end attached to the sliding handle on that rail. Each elastic cord rises through the open top of the rail and wraps over a pulley mounted at that end, then runs downwardly outside the rail for attachment to the handle. The inner end of the elastic cord is attached to an anchor block which is in turn fixed inside the rail, preferably by the expedient of dimples punched in the wall of the tubular rail and into the anchor block. Each handle includes a sleeve slidable along the rail, and a handle grip fixed horizontally to the sleeve, such that the handles extend sideways and away from each other on the two parallel rails. The preferred rails are tubes of rectangular configuration, and the sleeves likewise have a rectangular cross section closely fitting the exterior of the rails, so that the handles are prevented from turning about the axis of the rail tube.

The rails are supported in mutually parallel relationship by a bottom end-fitting slidable within the tubular support of the frame, and a housing which encloses the pulleys, which are pivotable mounted within this housing. An end cap closes the upper end of the tubular support and is apertured to pass the two rails, allowing the rails to slide through the cap. Sliding movement of the rails is limited by the cap which stops upward movement of the bottom end fitting. A second pair of handles may be fixed near the upper end of the tubular support member for use as alternate supports instead of the slidable handles of the climber portion of the machine.

These and other improvements, features and characteristics of the novel collapsible exerciser will be better understood by reference to the following detailed description of the preferred embodiment and accompanying drawings.

DETAILED DESCRIPTION OF THE PREFERRED EMBODIMENTS

Figure 1:
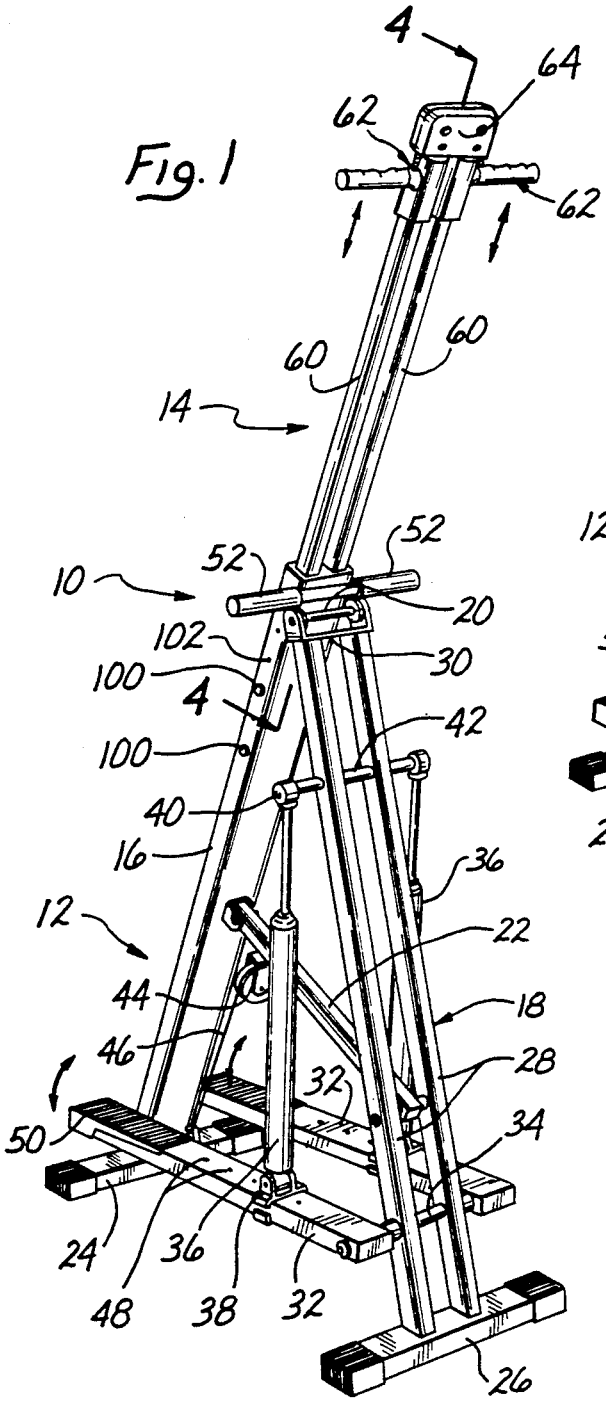
FIG. 1 is a perspective view of the stepper/climber exercise machine shown with the climber portion in extended operative condition.

With reference to the attached drawings, FIG. 1 shows the combination stepper/climber exercise machine generally designated by numeral 10, and which includes a lower stepper portion generally indicated by numeral 12 and an upper climber portion 14. The stepper portion 12 includes an A-frame which includes a tubular support 16 and a rear support 18 hinged together at 20 and spread apart at their lower ends, connected at a mid point of each member by a cross member 22, which fixes the spread between the two members 16, 18. The two support members 16, 18 are held erect and free standing on two parallel base elements 24, 26 respectively. The rear support 18 is made up of two parallel elements 28 fixed in spaced apart relationship by a hinge bracket 30 at their top ends and base element 26 at their bottom ends. Two elongated foot levers 32 are pivoted on a transverse shaft 34 mounted on the rear support 18. Two hydraulic cylinders 36 each have a lower end 38 connected to a mid point of a corresponding foot lever 32 and an upper end 40 pivoted to a transverse shaft 42 mounted on the rear support member 18. A pulley 44 is suspended from the cross member 22 and a cable 46 runs over the pulley and is attached at its opposite ends to the two foot levers 32. This pulley arrangement synchronizes the two foot levers such that as one is depressed, the cable 46 pulls the other foot lever 32 upwardly, and vice-versa, as the other foot lever is then depressed, the first foot lever is pulled up. The up-and-down movement of the foot levers is damped by the two resistance cylinders 36 to provide a relatively slow displacement of the foot levers requiring significant effort on the part of the user, thus emulating the effort required in climbing a staircase. The degree of effort required can be adjusted by displacing the attachment point 38 of the resistance cylinders along the length of the foot lever 32, for which purpose a number of holes 48 are provided which receive a fastener which fixes the cylinder 36 to the foot lever.

The climber portion is typically used by stepping onto the foot pads 50, grasping handles 52 with both hands for support, and then alternatively shifting body weight from one foot lever 32 onto the other to achieve an up-and-down pedaling motion of the levers 32.

The frame member 16 is of rectangular cross-section, and is relatively large in cross-section as compared to the elements 28 of the rear support member 18.

The A-frame folds for storage by detaching the cross-member 22 from one or both of the support members 16, 18, detaching the cable 46 from the foot levers 32, and detaching resistance cylinders 36 from the foot levers 32, so that the foot levers, the resistance cylinders 36, the cross-member 22 and the support member 16, 18 all fold to a flat, elongated package by bringing the two base members 24, 26 together.

Figure 3:
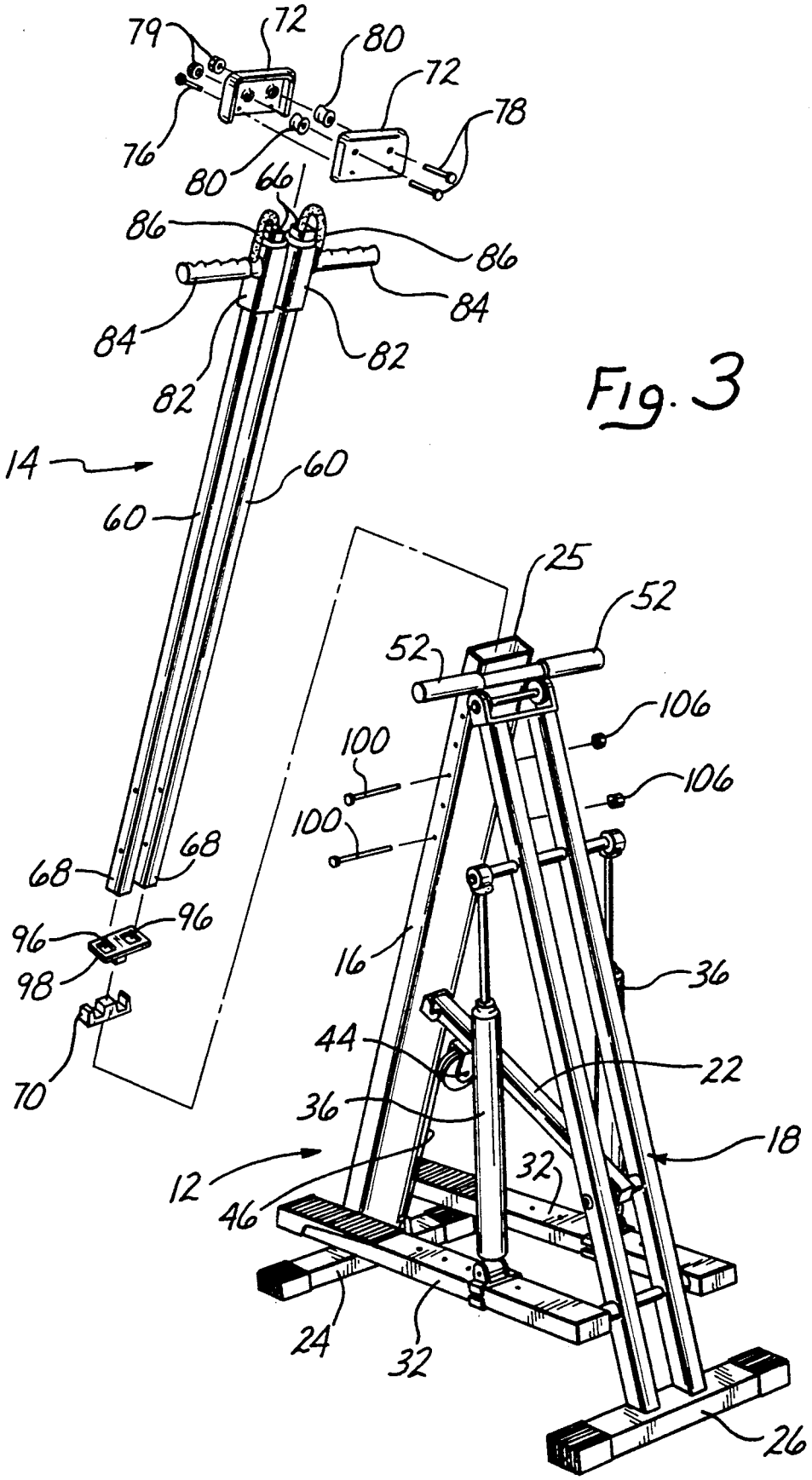
FIG. 3 is a perspective view of the machine of FIG. 1 with the climber assembly exploded to show its component elements.
Figure 4:
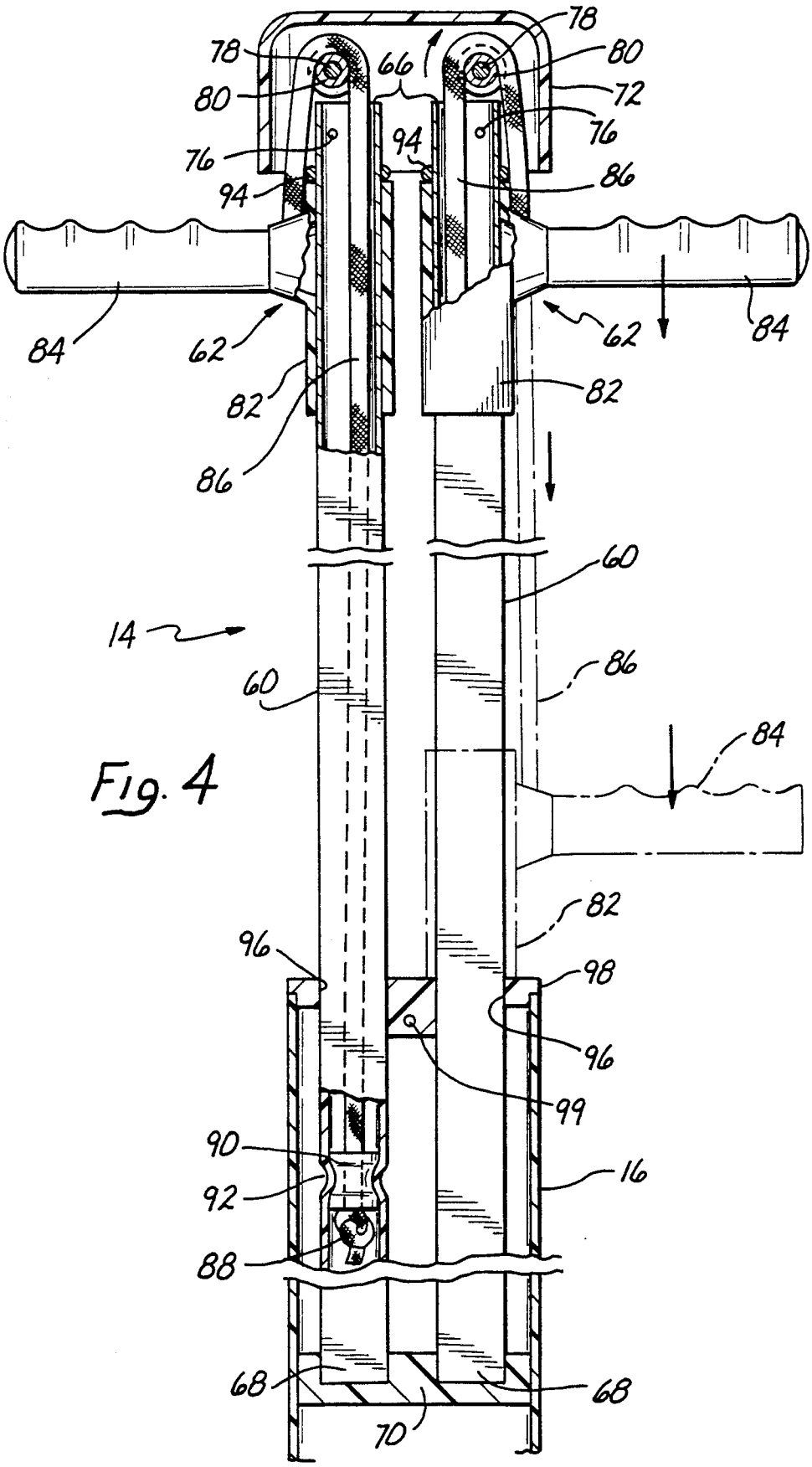
FIG. 4 is a front view, partly in section taken along line 4—4 in FIG. 1, of the retractable climber portion of the machine of FIG. 1.

The climber portion 14 includes two parallel rails 60, and a handle 62 independently slidable along each rail 60, as indicated by the arrows in FIGS. 1 and 4. The construction of the climber unit is better understood by reference to FIGS. 3 and 4 of the drawings. FIG. 3 shows each rail 60 with an open upper end 66 and lower ends 68. The two rails 60 are preferably metallic tubing of square cross-section. The lower ends 68 are set recesses formed in a bottom end-fitting 70 which is slidable within the support member 16, as best appreciated in FIG. 4. The top ends 66 of the rails are fixed between two halves 72, best seen in FIG. 3, which are joined and held together by two pairs of screws 76, 78 to form the upper end housing 64 seen in FIGS. 1 and 2. The screws which hold the housing 64 together are arranged in a rectangular array, with the lower pair of screws 76 passing through the rails 60, as shown in FIG. 4. The screws 76 holds the two halves 72 together and also fix the upper ends of the rails 60 between the two joined together halves 72. The second pair of screws 78 threaded into nuts 79 also hold together the two halves 72, and also serve as bearing shafts for two pulleys 80 which are each rotatably supported between the two halves 72 on one of the screws 78, as illustrated in FIGS. 3 and 4.

Each handle 62 includes a sleeve 82 of rectangular cross section and slides closely along the rail 60, and a hand grip 84 affixed to the sleeve 82 transversely to the rails 60. The two hand grips 84 extend away from each other on the two rails 60, as best seen in FIG. 4. An elastic cord 86 extends within each rail 60 to an inner end 88 secured to an anchor block 90 fixed within the rail 60. The anchor block 90 may be a block of plastic material perforated to pass the cord 86, which is tied in a knot below the block 90, and the anchor block is fixed by the expedient of punching dimples 92 in the wall of the rail tubing, deforming wall material into the anchor block, as seen in FIG. 4. The cord 86 emerges from the open top end 66 of the rail 60 and wraps over the pulley 80, from where the cord runs down outside the rail 60 through the open bottom of the top end housing 64 to the handle 62, to which it is affixed at its outer end. The length of the elastic cord 86 is such as to normally pull the handle 62 to the top of the rail 60 against the top end housing 64. Rubber bands 94 are provided around the rail 60 just below the top end housing 64 to serve as shock absorbing bumpers for the handles 62.

The user grasps the hand grips 84 while standing on the foot levers 32 of the machine 10, and pulls down alternatively on each of the hand grips 84, stretching the cords 86 and sliding the handles 62 down along the corresponding rail 60 from the upper solid lined position to the lower, phantom lined position indicated for the right-hand handle 62 in FIG. 4. When pulling force is released on the handle 62, it is returned to its elevated, solid lined position by the elastic cord 86 which returns to its normal unstretched length.

The two rails 60 pass through closely dimensioned rectangular openings 96 in an end cap 98 which fits into and closes the open top end 25 of the tubular support member 16, as indicated in FIG. 3. The end cap 98 is fixed in place by a screw which passes through the side wall of the support member 16 and into a hole 99 in the end cap, shown in FIG. 4. The two rectangular openings 96 in the end cap 98 conform closely to the cross section of the parallel rails 60, and allow sliding movement of the rails through the cap 98. As already explained, the lower ends of the rails are supported on an end fitting 70 which slides within the support member 16. The rails 60 are therefore supported within the tubular member 16 at two spaced apart points, namely their bottom ends 68 and at the cap 98, while also being free to slide into and out of the tubular member 16.

Figure 2:
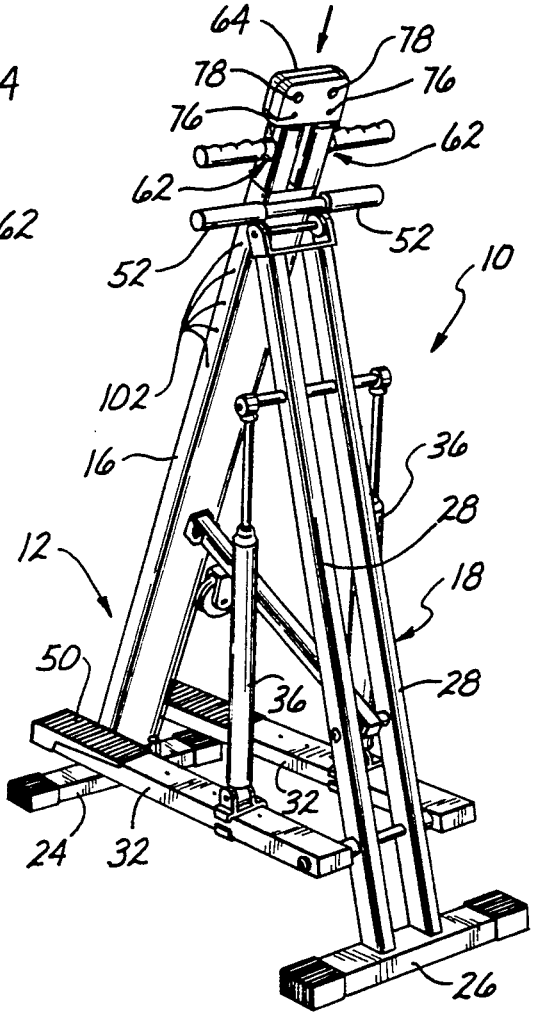
FIG. 2 is a perspective view as in FIG. 1 but showing the machine in its compact configuration, with the climber assembly fully retracted.

The climber assembly 14 is collapsible from an extended, operational position, shown in FIG. 1 to a collapsed or retracted condition illustrated in FIG. 2. In the extended position of FIG. 1, the rails are fixed relative to the tubular support 16 by means of transverse bolts 100, seen in FIG. 3, which pass through aligned holes 102, 104 in the support member 16 and rails 60 respectively, and are retained in place by threaded end knobs 106. When it is desired to store away or transport the exercise machine 10, the bolts 100 are removed, thereby freeing the rails 60 for sliding movement within the tubular support member 16. The climber assembly 14 can then be slid down into the tubular support member 16 to the retracted condition shown in FIG. 2.

It will be appreciated that the unit 10 can be shipped more conveniently and economically for commercial distribution in the collapsed condition, and yet can be very easily and quickly set up for use by the average, mechanically unskilled user, by pulling up on the handles 62 until the climber unit is extended as in FIG. 1, and then installing the bolts 100 to fix the climber portion in its extended position. The entire climber assembly is of simple yet dependable design.

While a preferred embodiment of the invention has been described and illustrated for purposes of clarity and example, it must be understood that many changes, substitutions and modifications to the described embodiment will become apparent to those possessed of ordinary skill in the art without thereby departing from the scope and spirit of the present invention which is defined by the following claims.

What is claimed is:

1. A physical exercise machine collapsible from an operative extended configuration to a compact configuration, comprising:

a stepper exercising assembly including a tubular support member; and a climber exercising assembly including a pair of handles individually slidable on parallel tubular rails against tension of spring elements contained in said rails;

characterized in that said rails are retractable into said tubular support member for collapsing said machine from said extended to said compact configuration.

2. The machine of claim 1 wherein said spring elements are elastic cords each having one end anchored within one of said rails and an opposite end attached to one of said handles.

3. The machine of claim 2 wherein said elastic cords are wrapped over pulley means mounted at an upper free end of said rails.

4. A physical exercise machine of the stepper/climber combination type, said machine being collapsible from an operative extended configuration to a compact configuration, comprising:

a stepper exercising assembly having a supporting base including a tubular support member, a pair of elongated foot operated levers pivoted to said base arrangement and synchronized by an interconnecting pulley arrangement such that one lever rises when the other is depressed, said levers being connected to a resistance device for resisting movement of the levers; and a climber exercising assembly having a pair of handles individually slidable on parallel tubular rails, elastic means anchored within said rails and biasing said handles towards an elevated position on said rails from where the handles can be pulled down against by a user against said biasing, said rails being slidable in said tubular support element between an extended operative configuration and a retracted compact configuration.

5. The machine of claim 4 wherein said elastic means are elastic cords wrapped over pulley means mounted at an upper free end of each said rails.

6. The machine of claim 5 wherein said elastic cords are secured to anchor elements fixed within said rails.

7. The machine of claim 4 wherein said handles each include a sleeve slidable along one of said rails and a handle grip extending transversely to said rails, the grips on said pair of handles extending away from each other.

8. The machine of claim 4 wherein said rails are supported in mutually parallel relationship slidable within said tubular support member by an end fitting slidable in said tubular support and a cap closing an upper end of said tubular support, said rails sliding through openings in said cap.

9. The machine of claim 4 further comprising a second pair of handles fixed to said tubular support member for use alternate to the handles slidable on said rails.

10. A physical exercise machine of the stepper/climber combination type, said machine being collapsible from an operative extended configuration to a compact configuration, comprising:

a stepper exercising assembly having a supporting base including a tubular support member, a pair of elongated foot operated levers pivoted to said base arrangement and synchronized by an interconnecting pulley arrangement such that one lever rises when the other is depressed, said levers being connected to a resistance device for resisting movement of the levers; and a climber exercising assembly having a pair of handles individually slidable on parallel tubular rails, elastic cords wrapped over pulley means mounted at an upper free end of each said rails, said elastic cords secured to anchor elements fixed within said rails and attached for biasing said handles towards an elevated position on said rails, each said handle including a sleeve slidable along one of said rails and a handle grip extending transversely to said rails, the grips on said pair of handles extending away from each other for pulling down along said rails by a user against the bias of said elastic cords, said rails supported in mutually parallel relationship by an end fitting slidable in said tubular support and a cap closing an upper end of said tubular support, said rails sliding through openings in said cap between an extended operative configuration and a retracted compact configuration.

11. The machine of claim 10 further comprising a second pair of handles fixed to said tubular support member for use alternate to the handles slidable on said rails.

* * * * *